US007507141B2

(12) United States Patent
Ward et al.

(10) Patent No.: US 7,507,141 B2
(45) Date of Patent: Mar. 24, 2009

(54) STRAP COUPLING

(75) Inventors: Bernie Ward, Dublin (IE); Marese Hickey, Dublin (IE)

(73) Assignee: Embrace Limited, Dublin (IE)

( * ) Notice: Subject to any disclaimer, the term of this patent is extended or adjusted under 35 U.S.C. 154(b) by 0 days.

(21) Appl. No.: 10/488,649

(22) PCT Filed: May 21, 2003

(86) PCT No.: PCT/EP03/05443

§ 371 (c)(1),
(2), (4) Date: Nov. 1, 2004

(87) PCT Pub. No.: WO03/096831

PCT Pub. Date: Nov. 27, 2003

(65) Prior Publication Data

US 2005/0054264 A1 Mar. 10, 2005

(30) Foreign Application Priority Data

May 21, 2002 (IE) ..... S2002/0406

(51) Int. Cl.
*A41C 3/00* (2006.01)

(52) U.S. Cl. ..... 450/86; 2/69

(58) Field of Classification Search ..... 450/86, 450/87, 88; 2/69, 73, 113, 458, 401, 23, 2/240; 24/498, 537; 224/272, 195, 614
See application file for complete search history.

(56) References Cited

U.S. PATENT DOCUMENTS 694,857 A * 3/1902 Henshaw ..... 24/498
1,660,778 A * 2/1928 Brett ..... 2/73
1,677,109 A * 7/1928 Isaac ..... 24/507
1,723,147 A * 8/1929 Baptiste ..... 224/197
1,866,081 A * 7/1932 Brown ..... 2/113
2,580,477 A * 1/1952 Statham ..... 24/639
2,590,881 A * 4/1952 Morgan ..... 24/565
3,136,020 A * 6/1964 Baker ..... 24/498
3,179,109 A * 4/1965 Born ..... 450/83
3,193,842 A * 7/1965 Bell ..... 2/94
3,200,821 A * 8/1965 Anderson ..... 450/68
3,527,231 A * 9/1970 Catanese et al. ..... 450/60
3,711,867 A * 1/1973 Mott ..... 2/230
3,763,865 A * 10/1973 DeFru ..... 450/41
5,819,381 A * 10/1998 Lake ..... 24/564
D409,114 S 5/1999 Bortner
6,086,451 A * 7/2000 Fernandes ..... 450/86
6,098,859 A * 8/2000 Bortner ..... 224/272
6,547,636 B1 * 4/2003 Cato ..... 450/88

* cited by examiner

*Primary Examiner*—Gary L Welch
*Assistant Examiner*—Richale L Quinn
(74) *Attorney, Agent, or Firm*—Van Dyke, Gardner, Linn & Burkhart, LLP

(57) ABSTRACT

The present invention is concerned with a coupling for use in securing a strap to a garment, for example on a bra or bikini, the coupling comprising a slideway adapted to be secured to the body of the garment, and a slider connectable to the strap, the slider being shaped and dimensioned for sliding engagement with the slideway, the slider also preferably being operable to be releasably secured at any position along the slideway.

10 Claims, 4 Drawing Sheets

STRAP COUPLING

The present invention relates to a coupling for securing a strap to a garment, and in particular a coupling which permits the position at which the strap is secured to the garment to be varied as desired. The invention is primarily intended for use with bra straps or the like, but is not limited thereto, and is applicable to any garment which includes one or more straps.

It is often the case that a particular top or dress is unsuitable to be worn with a bra, as the straps of the bra are not covered by the item of clothing, and are therefore visible. Such items of clothing include, for example, a halter neck top/dress, a shoulderless top/dress, a top/dress having an enlarged open neck or back, or a top/dress which itself includes over the shoulder straps.

There are a number of semi-successful solutions to the above mentioned problems, although these solutions do still suffer from a number of drawbacks, and therefore remain largely undesirable and unsuitable for many purposes. Such a solution is the strapless bra, which does not include any over-the-shoulder straps, thus overcoming the problems discussed above, but resulting in further problems which render such strapless bras uncomfortable and often ill fitting. Specifically, due to the lack of straps, such bras offer greatly reduced support, and may thus be uncomfortable, particularly when worn for prolonged periods. In addition, in an attempt to compensate for this lack of support, strapless bras are often designed with increased underwire support, which can add to the discomfort experienced when wearing same.

An alternative solution to the above problems is to manufacture bra straps out of transparent material, generally plastic, such as to reduce the visibility of the straps and thus allow the bra to be worn with clothing that does not actually cover the straps. However, despite being transparent, these bra straps do remain clearly visible, particularly at close range, and are therefore found undesirable by many women. In addition, as these straps are generally manufactured from plastic, they can be quite uncomfortable to wear, digging into the shoulders, in addition to causing perspiration due to the lack of breathability. These plastic straps are also considerably less durable than conventional fabric straps, and have a tendency to break under pressure.

A related problem exists with the straps of bikini tops or sun-tops, the position of which straps cannot be varied, thereby resulting in the formation of strap-marks when sunbathing, which is again found highly undesirable by most women, the only real solution to which is to wear the straps off the shoulders, thereby again resulting in the problems associated with the strapless bra.

It is therefore an object of the present invention to provide a solution to the above-mentioned problems.

It is a further object of the present invention to provide a coupling for use in securing a strap to a garment, which coupling permits variation in the position at which the strap is secured to the garment.

It is a still further object of the present invention to provide a garment, having one or more straps, each of which are secured to the garment, at least one end of each strap, by such a coupling.

The present invention therefore provides, in a first aspect, a coupling for use in securing a strap to a garment, the coupling comprising a slideway adapted to be secured to the garment, and a slider connectable to the strap, the slider being shaped and dimensioned for sliding engagement with the slideway.

Preferably, the slider is operable to be releasably secured at any position along the slideway.

Preferably, the slider comprises a clamp which is urged, at least partially, into engagement with the slideway in order to secure the slider relative thereto.

Preferably, the clamp is pivotally mounted to the slider, the clamp including a first end engaging the slider, and a second end which is displacable in order to disengage the first end from the slideway such as to permit the slider to be moved along the slideway.

Preferably, the slideway comprises a rail to which the slider is connectable, and a skirt projecting from the rail for securing the slideway to the garment.

Preferably, the slider may be disengaged from the slideway.

Preferably, the slideway is substantially spatulate in cross-section.

Preferably, the rail is substantially cylindrical, the slider being engagable about the rail, the rail contacting surface of the slider therefore being substantially penannular.

Preferably, the slideway is at least partially formed from a resiliently deformable material, most preferably a plastic or rubber.

Preferably, the slideway contacting surface of the slider has a high co-efficient of friction.

Preferably, the slider is at least partially formed from metal, and is provided with a protective coating thereon.

Preferably, the protective coating is substantially thermally insulating.

According to a second aspect of the present invention, there is provided a garment having a strap secured thereto, at least one end of the strap, by a coupling according to the first aspect of the invention.

Preferably, the garment is a bra, swimsuit, dress, or the like.

As used herein, the term "slideway" is intended to mean an elongate element which defines a path along which another element or object may travel, said object preferably being constrained by the slideway for movement therealong.

As used herein, the term "slider" is intended to mean any object or element which is adapted to run on a slideway as hereinbefore defined, the slider preferably being adapted to be releasably secured at any position along the slideway.

As used herein, the term "spatulate" is intended to mean a shape having a broad, preferably rounded end, and a narrow, attenuated base.

The present invention will now be described with reference to the accompanying drawings in which.

Figure 3:
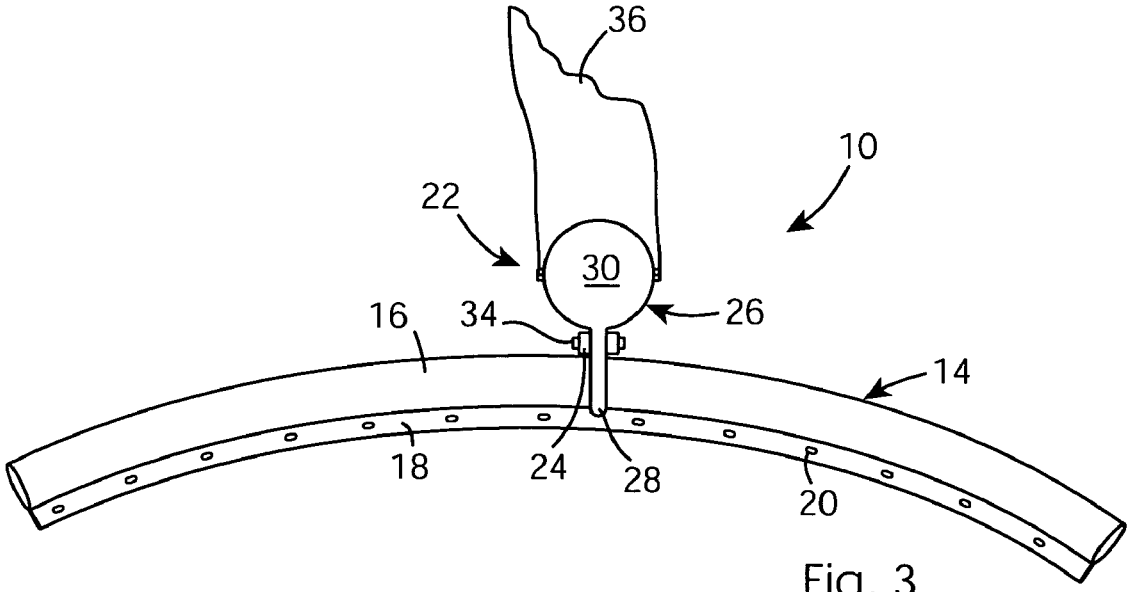
FIG. 3 illustrates a front elevation of the coupling of FIG. 1.
Figure 4:
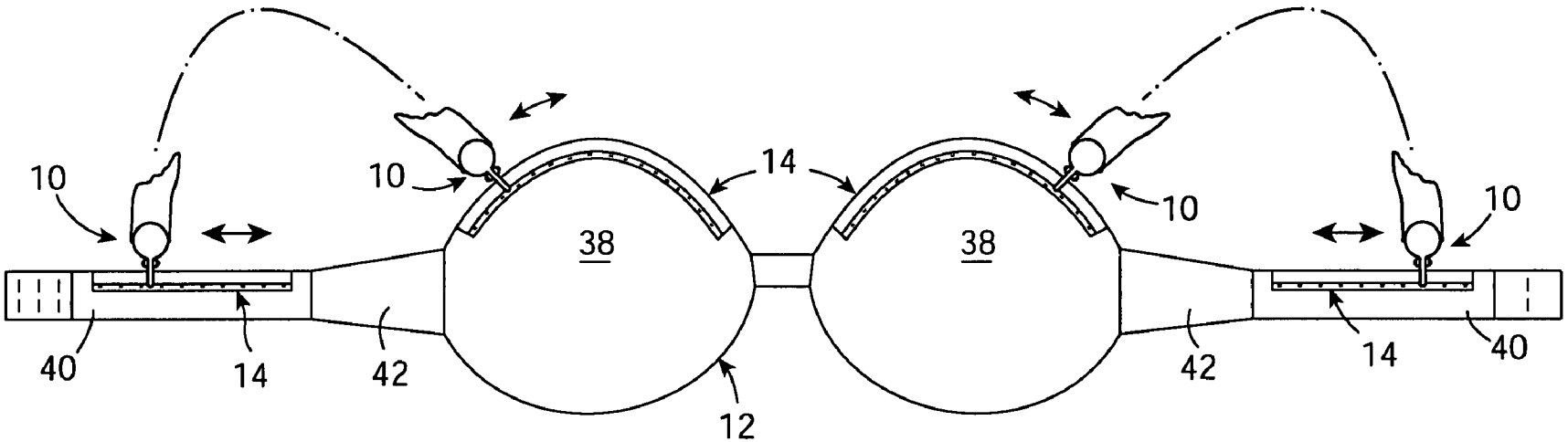
FIG. 4 illustrates a front elevation of a garment, according to a second aspect of the invention, incorporating the coupling of the first aspect of the invention.

Turning now to FIGS. 1 to 4 of the accompanying drawings, there is illustrated a first embodiment of a coupling according to the invention, generally indicated as 10, which coupling 10 is intended for use in securing a strap 36 at one or both ends, to a garment, for example a bra 12 as illustrated in FIG. 4 of the accompanying drawings. It will however be appreciated from the following description of the configuration and operation of the coupling 10, that the coupling 10 is suitable for use with any garment (not shown) which includes one or more straps (not shown) secured thereto. For the purposes of describing the configuration and operation of the coupling 10, the following description will be limited to describing the use of the coupling 10 with the bra 12, although reference to the bra 12 will of course be understood not to limit the scope of the invention to such a use.

The coupling 10 essentially comprises a slideway 14 which, in use, is secured to the bra 12, as will be described in greater detail hereinafter, and a slider in the form of a clasp 22, which clasp 22 is adapted for sliding engagement with the slideway 14. As the bra 12 is symmetrical about a centre thereof, it will be sufficient to describe the configuration and operation of the coupling 10 with respect to one side of the bra 12. It can also be seen from FIG. 4 that each strap 36 is secured to the bra 12 at both a cup 38 and a back 40, each end of the strap 36 being secured by means of a coupling 10. It will however be understood that it is not necessary that both ends of each strap 36 be secured by means of a coupling 10, which coupling 10 may only be included at one or other end of each strap 36.

In the embodiment illustrated, the slideway 14 comprises a rail 16, preferably cylindrical in form, and a skirt 18, projecting from the rail 16, the skirt 18 being relatively thin when compared to the rail 16, and being substantially planar in form. The skirt 18 is provided in order to permit the slideway 14 to be secured to the bra 12, and is thus provided with a plurality of apertures 20 along the length thereof. These apertures 20 permit the slideway 14 to be sewn, or otherwise secured, to the bra 12, both along the upper rim of each cup 38, and the upper edge of each back 40, as is illustrated in FIG. 4. It will be appreciated that each slideway 14 need not be secured to the bra 12 where shown, and that these positions are merely the conventional points at which to anchor straps, and are generally considered the most suitable location for securing the straps 36 to the bra 12. It will also be appreciated that for other garments (not shown), alternative locations may of course be chosen to best suit the garment in question.

It will further be apparent that the slideway 14 need not be provided with the skirt 18 and apertures 20, and that any other means of securing the slideway 14 to the bra 12 may be utilised. The slideway 14 could, for example, simply be secured to the bra 12 at each end of the slideway 14, although this would of course provide less support then that of the embodiment illustrated.

Figure 1:
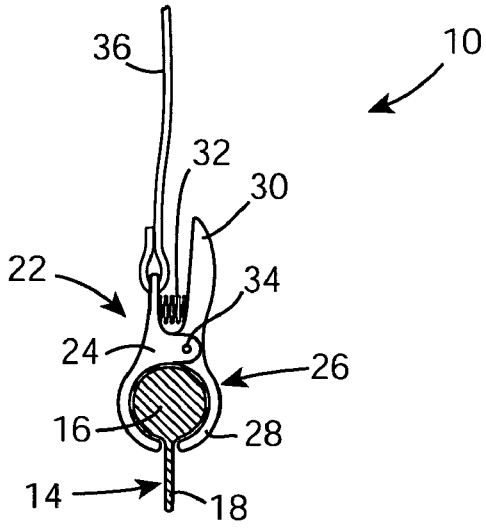
FIG. 1 illustrates a sectioned side elevation of a first embodiment of a coupling according to a first aspect of the present invention.
Figure 2:
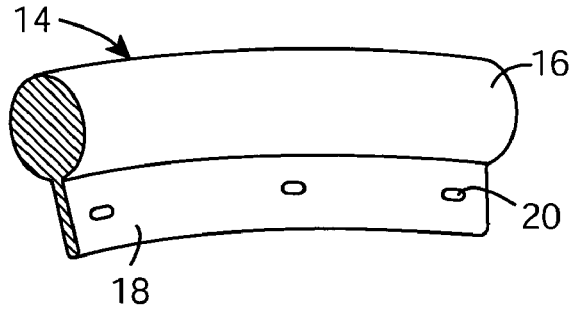
FIG. 2 illustrates a perspective view of a section of a first embodiment of a slideway forming part of the coupling of the present invention.

Turning now to FIGS. 1 and 3, the clasp 22 is shaped and dimensioned to be engaged about the rail 16 of the slideway 14, and to permit the clasp 22 to slide therealong. The clasp 22 comprises a body 24 to which is pivotally mounted a clamp 26 about a clamp axis 34. The clamp 26 includes a jaw 28 which, together with an opposed portion of the body 24, forms a substantially penannular contact surface which, in use, is engaged about the rail 16 of the slideway 14, with the skirt 18 projecting outwardly therefrom. The clasp 22 also includes a spring 32 which is positioned and arranged to urge the jaw 28 into engagement with the rail 16, such as to effect a clamping action in order to secure or fix the clasp 22 relative to the slideway 14.

The clamp 26 further comprises an arm 30 on the imposed side of the clamp axis 34 to the jaw 28, against which, in the embodiment illustrated, the spring 32 abuts. It will however be immediately understood that any other suitable means may be employed to urge the jaw 28 into contact with the rail 16. The arm 30 may be manually depressed, against the action of the spring 32, in a direction towards the body 24, such as to draw the jaw 28 out of contact with the rail 16. It will thus be appreciated that while the arm 30 is so depressed, the clasp 22 may be slid along the slideway 14 as desired, until the arm 30 is released. The clasp 22 is therefore selectively operable to enable variation of the position of the clasp 22 along the slideway. As the strap 36 is secured to the clasp 22, the clasp 22 and slideway 14 arrangement, forming the coupling 10, enables the position at which the strap 36 is secured to the bra 12 to be varied to suit any given item or style of clothing (not shown).

Although in the embodiment illustrated, the slideway 14 includes the rail 16, about which the clasp 22 is engaged, it will be understood that any other shape or suitable configuration of slideway (not shown) could be provided, along with a suitably co-operating clasp (not shown). For example, a slideway (not shown) could be provided in which is located a longitudinally disposed slot or keyway (not shown) into which a correspondingly shaped and dimensioned portion of the clasp (not should) could be slidably engaged. It will also be readily understood that the clasp 22 need not be spring loaded such as to actively grip or engage the rail 16, and the jaw 28 and body 24 could be formed integrally with one another without allowing relative movement therebetween. With such a configuration, the clasp (not shown) should be shaped and dimensioned for a close fit about the rail (not shown), such that in use, tension in the strap (not shown) will draw the rail contacting surface of the clasp tightly against the rail, such as to substantially prevent, in use, movement between the clasp and the slideway (not shown).

It is also envisaged that a slideway (not shown) could be provided which is of a composite form. For example, the rail (not shown) could be formed from metal, plastic, rubber, etc, while the skirt (not shown) could be formed from, for example, a fabric such as lace, lycra®, elastic or the like. Forming the skirt from fabric will allow the skirt to stretch and bend to suit the contour of the wearer's body. This configuration could then be used as a decorative trim, with the colour and style of fabric being varied as desired.

In the embodiment illustrated, the slideway 14 is preferably formed from a resiliently deformable material, for example a soft plastic or rubber, such as to be capable of deforming to follow the contour of the wearers' body, such as to provide a comfortable fit. It is therefore preferable that the rail contacting surface of the clasp 22 is provided with a high co-efficient of friction, such as to substantially eliminate, in use, any relative movement between the clasp 22 and the side rail 14, while the jaw 28 is in contact with the rail 16.

Referring again to FIG. 4, it can be seen that the bra 12 is provided with a side 42 connecting each cup 38 to the respective back 40, the side 42 preferably being formed of an elastic material such as to provide a degree of flexibility and elasticity to the bra 12, for reasons of comfort and fit. It is therefore envisaged that the slideway 14 on each cup 38 could extend across the respective side 42 and abut, or be formed integrally with, the slideway 14 secured to the respective back 40.

It will also be apparent that if the clasp 22 is slid to either free end of the respective slideway 14, the clasp 22 may be slid off the slideway 14, thereby allowing the strap 36 to be removed from the bra 12. It will therefore be appreciated that different straps (not shown), varying in, for example, shape, colour, etc., could be substituted in order to suit a particular item of clothing to be worn. Similarly, the strap 36 could be removed from one cup 38, and secured to the adjacent cup 38, such that the pair of straps 36 cross over each other either at the front or back, if required. Similarly, the clasp 22 secured to the slideway 14 on the back 40 could be moved inwardly towards the side 42, such as to prevent the straps 36 from falling off the shoulders of the wearer. It will be appreciated that some form of releasable closure member (not shown), such as a clip (not shown) or the like, could be provided on one or both free ends of the slideway 14, which closure member could be engaged with the slideway 14 to prevent the accidental uncoupling of the clasp 22 from the slideway 14. The closure member could also be uncoupled from the end of the slideway 14 to permit the clasp 22 to be drawn of the end of the slideway 14.

It is also preferable, in the embodiment illustrated, that the arm 30 may be depressed to the degree that the jaw 28 is drawn only slightly out of engagement with the rail 16, in order to allow the clasp 22 to slide therealong, without allowing the jaw 28 to be opened a distance which would permit the clasp 22 to be drawn out of engagement with the rail 16 such as to uncouple the strap 36 from the bra 12.

Figure 5:
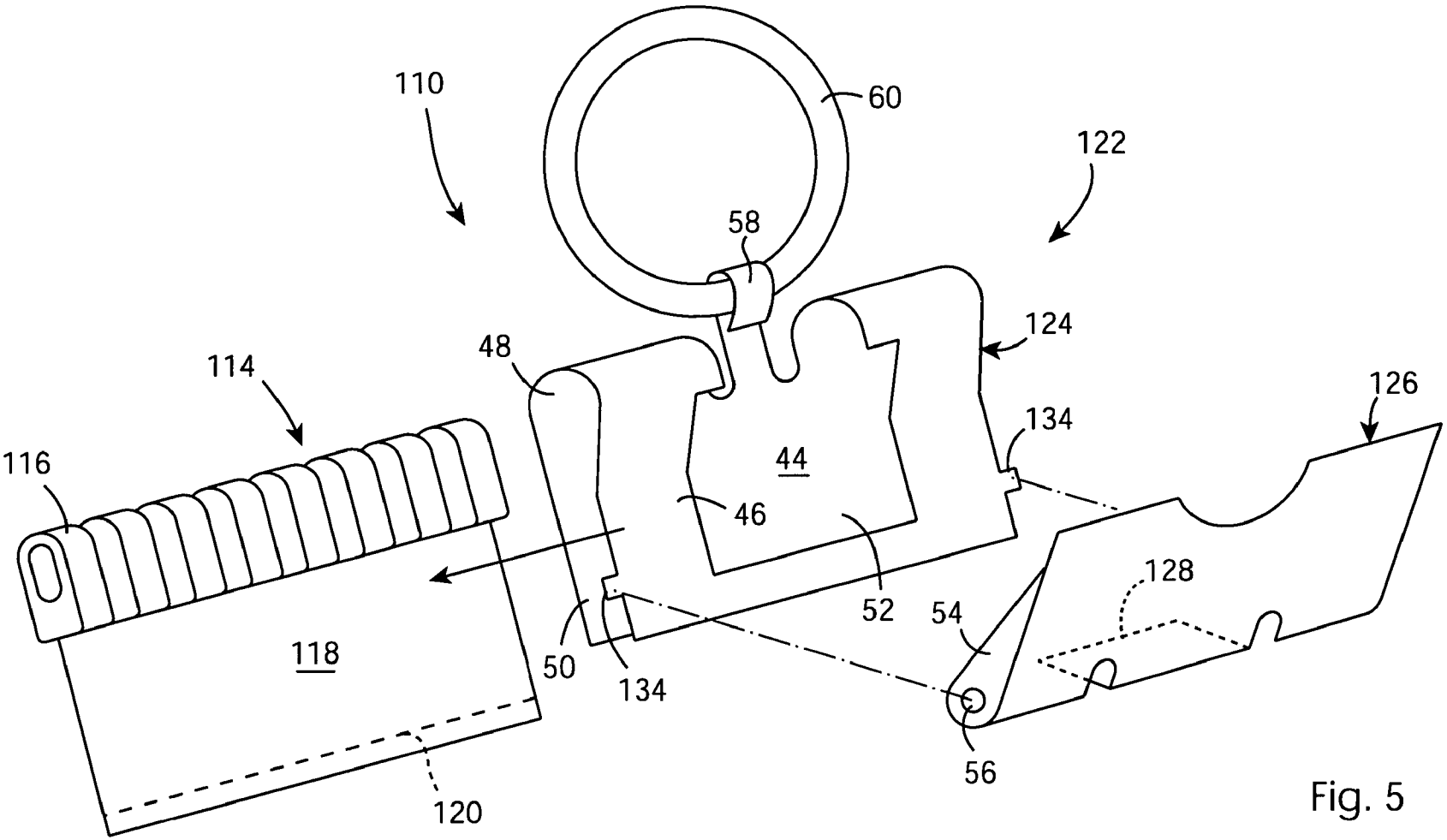
FIG. 5 illustrates a perspective, exploded view, of a second embodiment of a coupling according to the first aspect of the invention.
Figure 6:
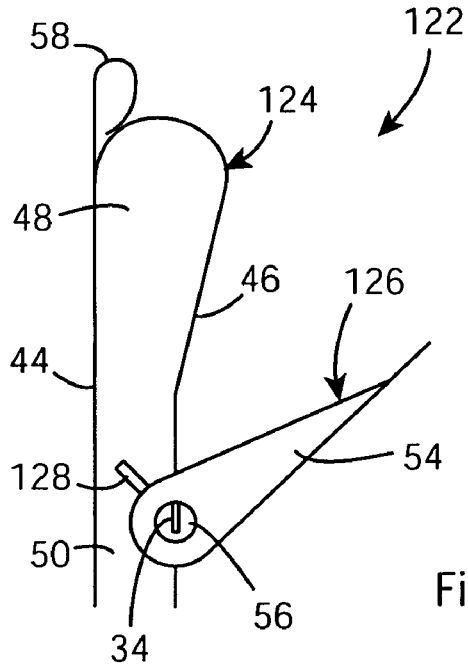
FIG. 6 illustrates a side elevation of a slider forming part of the coupling of FIG. 5, the slider being in an open position.
Figure 7:
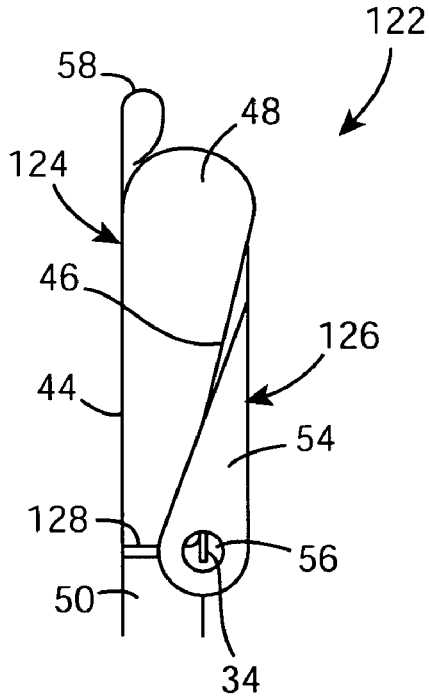
FIG. 7 illustrates a side elevation of the slider of FIG. 6, in a closed position.

Referring now to FIGS. 5 to 7, there is illustrated a second embodiment of a coupling according to the present invention, generally indicated as 110, which is again intended for use in securing a strap (not shown) at one or both ends, to a garment (not shown). With this second embodiment, like components have been accorded like reference numerals, and unless otherwise stated, perform a like function. The coupling again essentially comprises a slideway 114 which, in use, is secured to a garment (not shown), and a slider in the form of a clasp 122, which is adapted for sliding engagement with the slideway 114.

In this second embodiment, the slideway 114 is defined by one half of a conventional zip, the slideway 114 having a plurality of teeth which define a rail 116, and a skirt 118 which, as with most conventional zips, is preferably formed from fabric. The skirt 118 again permits the slideway 114 to be secured to a garment, such as the bra 12 shown in FIG. 4. Again as with conventional zips, stitching 120 may be utilised to secure the slideway 114 to a garment, although it will of course be appreciated that any other suitable means may be used. The slideway 114 is therefore, in use, substantially flexible, and can thus be deformed to suit garments of various shape and style, with which the coupling 110 is to be used.

The clasp 122 is shaped and dimensioned to be engaged primarily about the rail 116, and to be slid smoothly therealong. The clasp 122 comprises a body 124 to which is pivotally mounted a clamp 126 which, as with the first embodiment, is operable to secure the clasp 122 at any position along the slideway 114. The clamp 126, in FIG. 5, is shown separated from the body 124, in order to render clear the various features of both the body 124 and the clamp 126. The body 124 is defined by a rear wall 44 and a front wall 46, which are preferably formed from a single sheet of material, for example a metal or composite, between which are defined an enlarged channel 48, and a relatively narrow neck 50, thereby roughly mirroring the cross section of the slideway 114. The channel 48 is shaped and dimensioned to receive the rail 116, while the neck 50 is arranged to receive the skirt 118, the end of which, in use, projects beyond the neck 50 and is secured, as hereinbefore described, to a garment. The neck 50 is dimensioned such as to prevent the rail 116 from passing therethrough, and thus, in use, the clasp 122 is constrained to move along the slideway 114.

The front wall 46 is provided with a window 52 therein, in addition to a pair of pins 134 which together define a clamp axis about which, in use, the clamp 126 is hingedly mounted. The clamp 126 includes a pair of oppositely disposed sidewalls 54, each of which is provided with a single aperture 56 which, in use, receives the respective pin 134, in order to hingedly secure the clamp 126 to the body 124, in order to form the clasp 122. The clamp 126 also includes a jaw 128 which projects outwardly therefrom and which, in use, projects through the window 52 and is thus located within the neck 50, as can be seen in FIGS. 6 and 7. As with the body 124, the clamp 126 is preferably formed from a single sheet or piece of material, again such as a suitable metal or composite, which is simply bent or pressed into shape, thereby reducing the cost and time of manufacture.

Referring now in particular to FIGS. 6 and 7, the clasp 122 is shown from the side, without the presence of the slideway 114, which has been omitted for the purposes of clarity. In FIG. 6, the clamp 126 is situated in a first, open position, in which the jaw 128 is located distal the rear wall 44. It will be appreciated that in use the skirt 118 would pass between the rear wall 44 and the jaw 128, while the rail 116 would be seated within the channel 48. It is therefore apparent that when the clamp 126 is in this open position, the clasp 122 is free to move along the slideway 114 to any desired position.

Referring now to FIG. 7, the clamp 126 has now been hinged upwardly into a second, closed position in which the jaw 128 is pressed into contact with the rear wall 44. In this position, in use, the skirt 118 is firmly clamped between the rear wall 44 and the jaw 128, thereby preventing relative movement between the slideway 114 and the clasp 122. The interference fit between the jaw 128 and the rear wall 44, when the clamp 126 is in the closed position, ensures that the clamp 126 remains locked in the closed position. In addition, as the coupling 110 serves to secure two parts together, namely a garment and strap (not shown), which would otherwise separate from one another, the coupling 110 experiences a force which acts to pull the slideway 114, in use, downwardly against the clasp 122. As the skirt 118 of the slideway 114 is in contact with the jaw 128, this force bears against the jaw 128, via the skirt 118, in a direction which maintains the clamp in the closed position shown in FIG. 7. In order to release the clasp 122, the clamp 126 is simply manually displaced into the open position, wherein the clasp 122 may be moved to an alternative position along the slideway 114. Thus, as with the first embodiment, the clasp 122 is selectively operable to enable variation of the position of the clasp 122 along the slideway 114.

The clasp 122 is provided with a hook 58 which projects upwardly from the rear wall 44, and a ring 60 secured within the hook 58, in order to allow a strap (not shown) to be secured to the clasp 122 by any suitable means. As a strap is secured, in use, to the clasp 122, the clasp 122 and slideway 114 arrangement enables the position at which a strap is secured to a garment (not shown) to be varied for whatever reason.

The clasp 22; 122, if formed from a metal or other thermally conductive material, may be provided, partially or wholly, with any suitable thermally insulating coating (not shown). The colour and/or texture of said coating may then be chosen to suit a particular colour or style of garment (not shown) to which the coupling 10; 110 is to be secured.

As a further preferred feature, the coupling 10; 110, when in position on a garment (not shown), may be sandwiched between two strips of material (not shown), preferably of fabric, such as to isolate the coupling 10; 110, in use, from a person's skin. A preferred arrangement is one where the pair of strips are secured along an edge (not shown) thereof to the slideway 14; 114 and therefore the garment (not shown) in question, at the base of the skirt 18; 118, preferably by means of the apertures 20 and stitching 120 respectively. An opposed edge (not shown) of each strip is not secured to the slideway 14; 114 or the garment (not shown), and thus the pair of strips (not shown) define, in cross section, a V-shaped enclosure within which the slideway 14; 114 is located.

It will thus be appreciated from the foregoing description that the coupling 10; 110 of the present invention may be used with any garment (not shown) which includes one or more straps (not shown), for example swimwear, underwear, dresses, tops, sportswear, etc, and may indeed be used in any other suitable application, for example for medical reasons or the like.

The invention claimed is:

1. A garment which is intended to be worn on the body of a person, said garment comprising at least one strap; and a coupling securing said strap to said garment, said coupling comprising a slideway secured to said garment and a slider connected to said strap, said slider operable to be releasably secured at any position along said slideway, said slideway being flexible and including a rail and skirt, said skirt projecting from said rail for securing said slideway to said garment, said slider having open ends receiving said rail and skirt of said slideway for sliding engagement with, and travel along, said slideway and an open side from which said skirt of said slideway extends when said slider is mounted on said slideway, said rail being larger in dimension than said open side of said slider to resist passage of said rail through said open side, said slider including a body having a first wall and a second wall joined to one another at a position spaced from said open side and defining a channel therebetween for receiving said rail and skirt of said slideway, said second wall including a window opening therethrough, said walls engaging and receiving said slideway in said channel, said slider also including a clamp overlying the exterior of said second wall and at least a portion of said window opening and pivotally mounted to said second wall in a position aligned with but spaced from said first wall, said clamp including a jaw projecting inwardly through said window opening to engage and clamp said slideway against said first wall when said slideway is received in said channel, said clamp also including a second end displaceable from a closed position to an open position in order to disengage said jaw from said slideway to permit said slider to be moved along said slideway, and said jaw pivoting toward said first wall when said second end moves from said open to said closed position and said slideway is urged outwardly from said open side whereby tension in said strap serves to bias said jaw into engagement with said slideway.

2. A garment according to claim 1, in which said slider may be disengaged from said slideway.

3. A garment according to claim 1, in which said slideway is substantially spatulate in cross-section.

4. A garment according to claim 1, in which said rail is substantially cylindrical, said slider being engagable about said rail, said slider having a rail contacting surface that is substantially penannular.

5. A garment according to claim 1, in which said slideway is at least partially formed from a resiliently deformable material, most preferably a plastic or rubber.

6. A garment according to claim 1, in which said slider includes a slideway contacting surface having a high coefficient of friction.

7. A garment according to claim 1, in which said slider is at least partially formed from metal, and is provided with a protective coating thereon.

8. A garment according to claim 7, in which said protective coating is substantially thermally insulating.

9. A garment which is intended to be worn on the body of a person, said garment comprising at least one strap and a coupling securing said strap to said garment, said coupling comprising a slideway secured to said garment, and a slider connected to said strap, said slider being shaped and dimensioned for sliding engagement with, and travel along, said slideway; said slideway being flexible and including half a conventional zip having a plurality of teeth defining a rail, said teeth connected to a skirt, said skirt secured to said garment; said slider having open ends receiving said teeth of said rail and said skirt for said sliding engagement with said slider, an open side from which said skirt extends when said slider is mounted on said slideway, and a body having a first wall and a second wall joined to one another at a position spaced from said open side and defining said open ends, said open side and a channel therebetween for receiving said rail and skirt of said slideway, said second wall including a window opening therethrough, said walls engaging and receiving said slideway in said channel, said slider also including a clamp which engages said slideway in order to secure said slider relative to said slideway, said clamp being pivotally mounted to the exterior of said second wall of said body and including a jaw projecting inwardly through said window opening to engage said skirt, said second wall being aligned with and spaced from said first wall, said clamp being pivotable toward and away from said first wall and being displaceable from an open position to a closed position to move said jaw toward said first wall, whereby said skirt is clamped between said first wall and said jaw to hold said slider in a desired position on said slideway when said jaw is engaged with said skirt and said second end is moved from said open position to said closed position.

10. The garment of claim 9, wherein said teeth of said rail are larger than said open side of said slider to resist passage of said rail through said open side.

* * * * *

UNITED STATES PATENT AND TRADEMARK OFFICE

CERTIFICATE OF CORRECTION

PATENT NO. : 7,507,141 B2
APPLICATION NO. : 10/488649
DATED : March 24, 2009
INVENTOR(S) : Bernie Ward and Marese Hickey It is certified that error appears in the above-identified patent and that said Letters Patent is hereby corrected as shown below:

Column 1:
Line 58, Insert --at-- before “at least”.

Column 2:
Line 29, Insert --at-- before “at least”.

Signed and Sealed this

Twenty-sixth Day of May, 2009

JOHN DOLL
*Acting Director of the United States Patent and Trademark Office*